US006484961B2

(12) United States Patent
Henry

(10) Patent No.: US 6,484,961 B2
(45) Date of Patent: Nov. 26, 2002

(54) MACHINE FOR TUCKING, LABELLING AND PALLETIZING SPOOLS AT THE OUTLET OF A WINDER OR ANY OTHER MACHINE PRODUCING SPOOLS OF THREAD AND PROCESS PRACTICED BY THIS MACHINE

(75) Inventor: Pierre Henry, Pfastatt (FR)

(73) Assignee: Superba, Mulhouse (FR)

( * ) Notice: Subject to any disclaimer, the term of this patent is extended or adjusted under 35 U.S.C. 154(b) by 53 days.

(21) Appl. No.: 09/749,770

(22) Filed: Dec. 28, 2000

(65) Prior Publication Data

US 2001/0006205 A1 Jul. 5, 2001

Related U.S. Application Data

(60) Provisional application No. 60/173,749, filed on Dec. 30, 1999.

(30) Foreign Application Priority Data

Dec. 29, 1999 (FR) ..... 99 16681

(51) Int. Cl.[7] ..... B65H 54/26; B65H 67/04; B65H 54/71

(52) U.S. Cl. ..... 242/475.9; 242/172; 242/473.7; 242/473.8; 242/487.7; 242/487.8

(58) Field of Search ..... 242/173, 473.7, 242/473.8, 475.9, 487.7, 487.8, 172, 457.8; 414/908

(56) References Cited

U.S. PATENT DOCUMENTS

| | | | | | |
|---|---|---|---|---|---|
| 3,595,491 | A | * | 7/1971 | Bourque | 242/475.7 |
| 3,621,190 | A | * | 11/1971 | Morikawa et al. | 242/487.7 X |
| 4,108,388 | A | * | 8/1978 | Schar | 242/473.8 |
| 4,335,859 | A | * | 6/1982 | Couvoisier | 242/473.7 |
| 4,610,404 | A | * | 9/1986 | Maccaferri | 242/473.7 |
| 4,621,778 | A | * | 11/1986 | Paravella et al. | 242/473.7 |
| 4,638,955 | A | * | 1/1987 | Schippers et al. | 242/473.8 |
| 4,834,308 | A | * | 5/1989 | Maccaferri | 242/473.7 |
| 5,066,190 | A | * | 11/1991 | D'Agnolo | 414/908 X |
| 5,425,509 | A | * | 6/1995 | Van Severen et al. | 242/172 X |
| 5,556,046 | A | * | 9/1996 | Irmen et al. | 242/475.9 |
| 6,193,185 | B1 | * | 2/2001 | Kim | 242/473.8 X |

FOREIGN PATENT DOCUMENTS

| | | |
|---|---|---|
| DE | 24 08 880 | 9/1975 |
| DE | 36 30 537 | 3/1987 |
| DE | 37 25 889 | 2/1989 |
| EP | 0 200 121 | 11/1986 |
| EP | 0 386 339 | 9/1990 |
| EP | 0500433 B1 | 8/1992 |
| FR | 2673171 B1 | 8/1992 |
| JP | 10 310 326 | 11/1998 |

* cited by examiner

*Primary Examiner*—Michael R. Mansen
*Assistant Examiner*—Minh-Chau Pham
(74) *Attorney, Agent, or Firm*—Young & Thompson

(57) ABSTRACT

A machine for tucking, labelling and palletizing spools at the outlet of winders or other machines producing spools of threads and the process practiced by this machine. The machine includes a station for positioning spools at the outlet of a winder or other machine producing spools and cutting the tag end of the thread, a robot or the like for grasping the spool, for supplying a turning plate and for unmounting the spools from the turning plate and palletizing them, a device for grasping, positioning, holding and cutting the length of the tag end of thread, a portion for needle tucking, or the like, and a labelling station, all of these stations an devices being computer controlled.

19 Claims, 10 Drawing Sheets

MACHINE FOR TUCKING, LABELLING AND PALLETIZING SPOOLS AT THE OUTLET OF A WINDER OR ANY OTHER MACHINE PRODUCING SPOOLS OF THREAD AND PROCESS PRACTICED BY THIS MACHINE

BACKGROUND OF THE INVENTION

The present invention relates to the field of the textile industry, in particular the handling of spools of threads at the outlet of a winder or any other machine producing spools of threads, and has for its object a machine for tucking, labelling and palletizing spools at the outlet of such machines.

The invention also has for its object a process practiced by such a machine.

DESCRIPTION OF THE RELATED ART

At present, spools formed on winders or at the outlet of other textile machines are generally subjected to different successive manual operations of tucking, gluing a distinctive label and palletizing before sending or transferred to another machine or to another work station. Thus, these operations can be carried out by one and the same operator who performs these successive operations.

However, such an operative procedure has the drawback of depending entirely on the speed of execution of the operator, such that the output is relatively low. Because of this, it is possible, to increase the speed of execution, which is to say removing the bobbins and processing them, to increase the number of operators. However, such an increase in the number of operators gives rise to a corresponding increase in the labor cost.

To overcome these drawbacks, there have been proposed different automatic tucking machines disposed at the outlet of winding machines or other machines producing spools, these automatic tucking machines using a tucking needle provided at its end with an eye and penetrating into the end of the spool to grasp the trailing end of the thread and to pull it, after a rotation of 90° about its longitudinal axis, through said end of the spool. It results that the thread end is maintained by its end rolled up in the thread on the spool and can be disengaged by a simple pull during subsequent use.

In such an embodiment, it is however necessary to impart to the tucking needle a relatively complex path, which requires a relatively cumbersome installation.

As to the labelling subsequent to this tucking operation, the latter can as the case may be also be carried out at a separate station, a robot then receiving the spools to arrange them on a pallet.

These known embodiments of handling spools at the outlet of winders or other machines producing spools, however does not permit carrying out these different operations rapidly, in a confined space and with a minimum of work force.

SUMMARY OF THE INVENTION

The present invention has for its object to overcome these drawbacks by providing a machine permitting completely handling the spools at the outlet of the winder or other machine producing spools whilst requiring no operator at a fixed station.

To this effect, the invention has for its object a machine characterized in that it is essentially constituted by a station for positioning spools, at the output of a winder or other machine producing spools, and cutting the tag end of the thread, by a robot or the like for grasping the spool, supplying it to a rotating plate and then removing the spool from the turning plate and loading them on a pallet, by a device for grasping, positioning, holding and cutting to length the tag end of the filament, by a means for needle tucking or the like, and by a labelling station, the assembly of these stations and devices being controlled by means of a computer control means.

The invention also has for its object a process for handling spools at the outlet of winders or other machines, which consists essentially in positioning said spools at the outlet of the machine that produces them, cutting the trailing end of the thread, grasping the spools by means of a robot or the like and bringing them onto a turning plate, grasping, positioning, holding and cutting to length the trailing end, tucking or fixing said thread by means of a tucking means with a needle or like securement means, if desired applying a label to each spool, then dismounting the individual spools and resting them on a reception pallet or the like, the assembly of the operation being controlled by a computer control means.

BRIEF DESCRIPTION OF THE DRAWINGS

The invention will be better understood from the following description, which relates to a preferred embodiment, given by way of non-limiting example, and explained with reference to the accompanying schematic drawings, in which.

DESCRIPTION OF THE PREFERRED EMBODIMENTS

Figure 1:
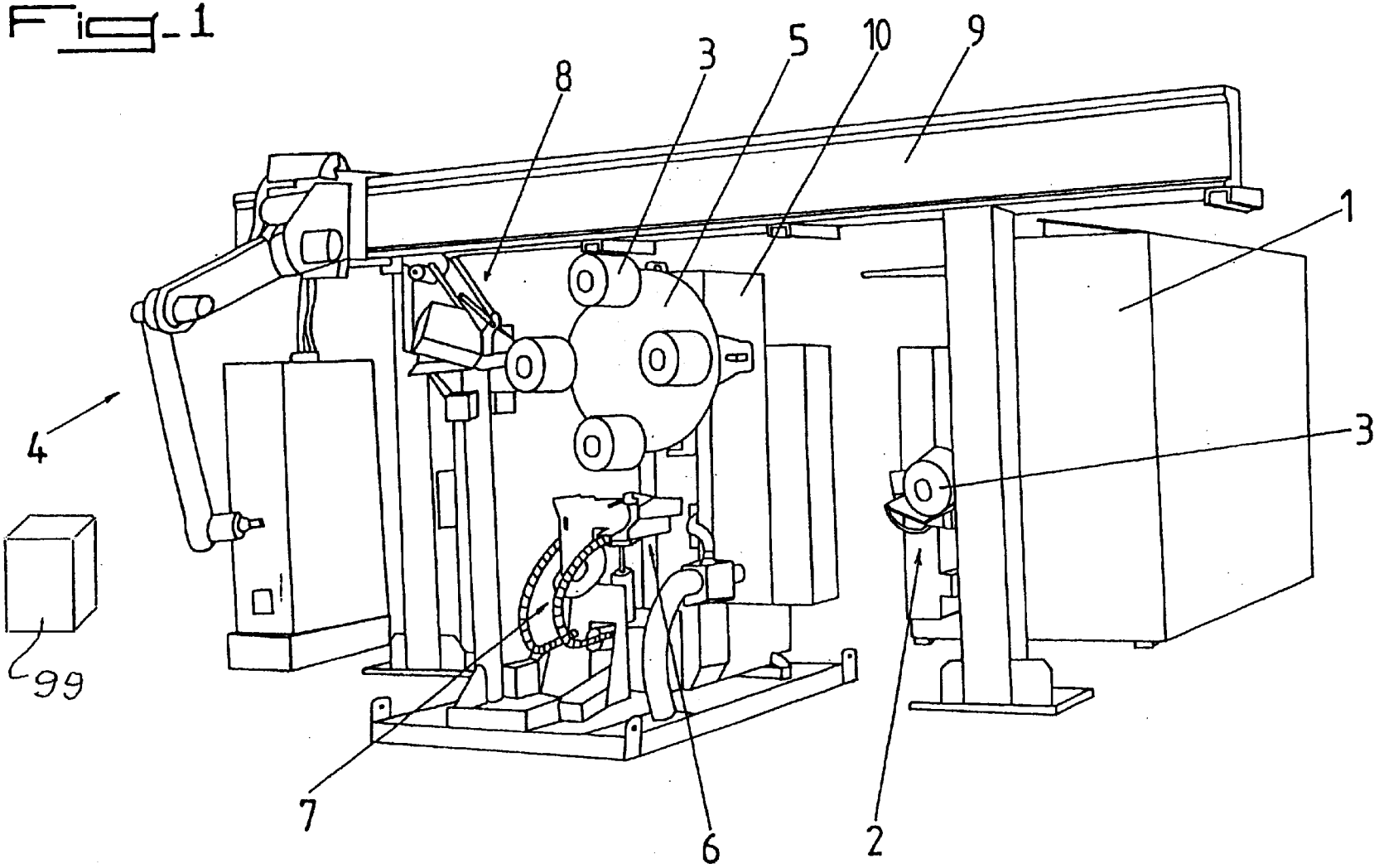
FIG. 1 is a schematic perspective view of a machine according to the invention.

FIG. 1 of the accompanying drawing shows schematically a winder 1 or other machine producing spools, this winder 1 or other machine being provided with means for complete processing of the outgoing spools.

According to the invention, this machine is essentially constituted by a station 2 for positioning spools 3 at the outlet of a winder 1 or other machine producing spools, and for cutting the tag end of the thread, by a robot 4 or the like to grasp the spool 3, to supply a turning plate 5 and to unmount the spools of said turning plate 5 and palletizing them, by a device 6 for grasping, positioning, holding and cutting to length the tag end of the thread, by a means 7 for needle tucking or the like, and by a labelling station 8, the assembly of these stations or devices being controlled by means of a data control system 99 to provide computer control.

The robot 4 or the like for grasping the bobbin 3 at the output of winder 1 or other machine producing bobbins, is advantageously constituted by an artificial brazier mounted on a cross-beam 9 extending in front of the output of the machine 1 and of the station 2 for positioning the spools 3 and above the turning plate 5 and of the device 6 for gripping, positioning, holding and cutting the tag end of the thread, as well as the means 7 for needle tucking and the station 8 for labelling (FIG. 1).

Figure 2:
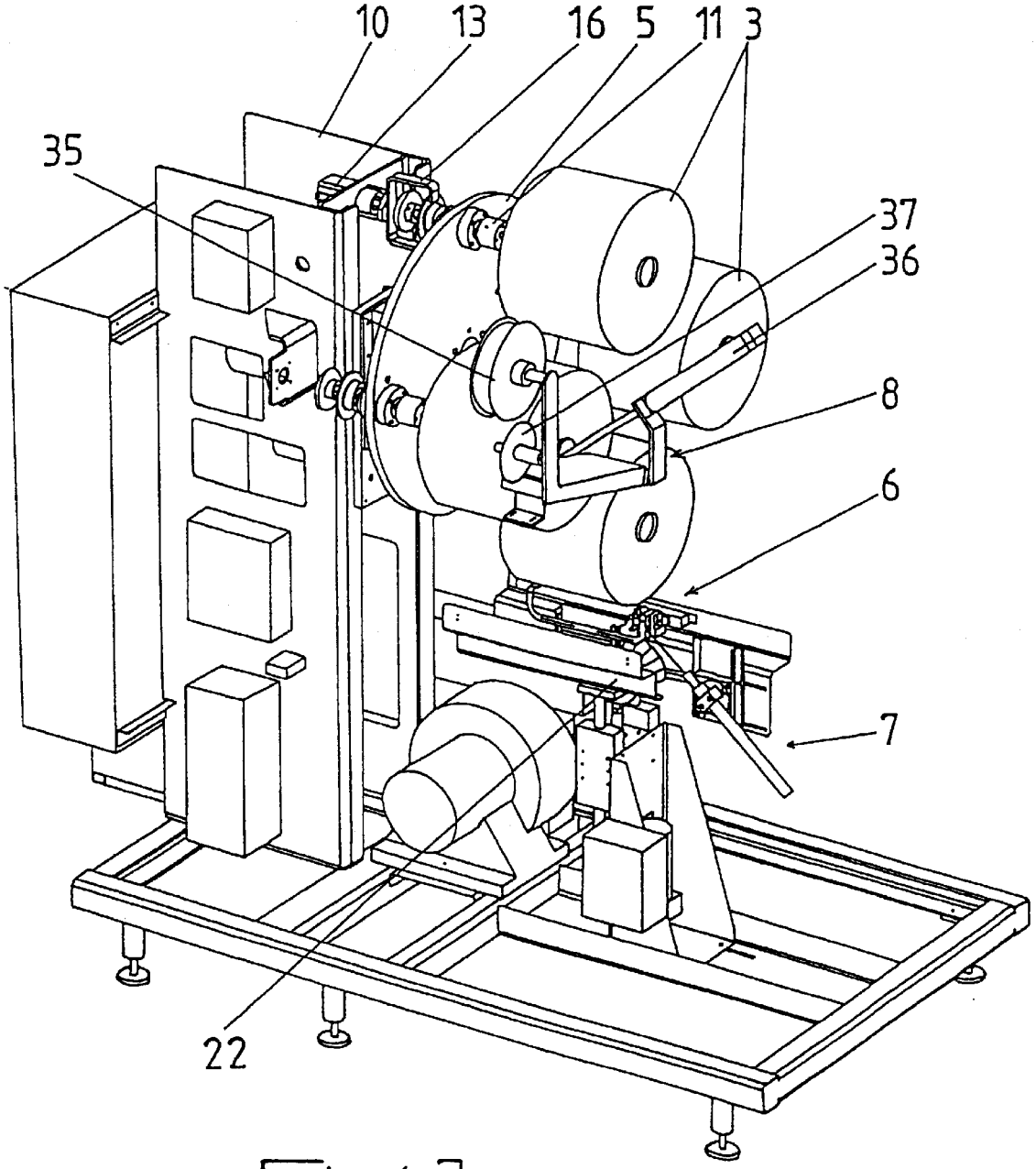
FIG. 2 is a perspective view on a larger scale of the turning plate, of the needle tucking means and of the labelling station.
Figure 10:
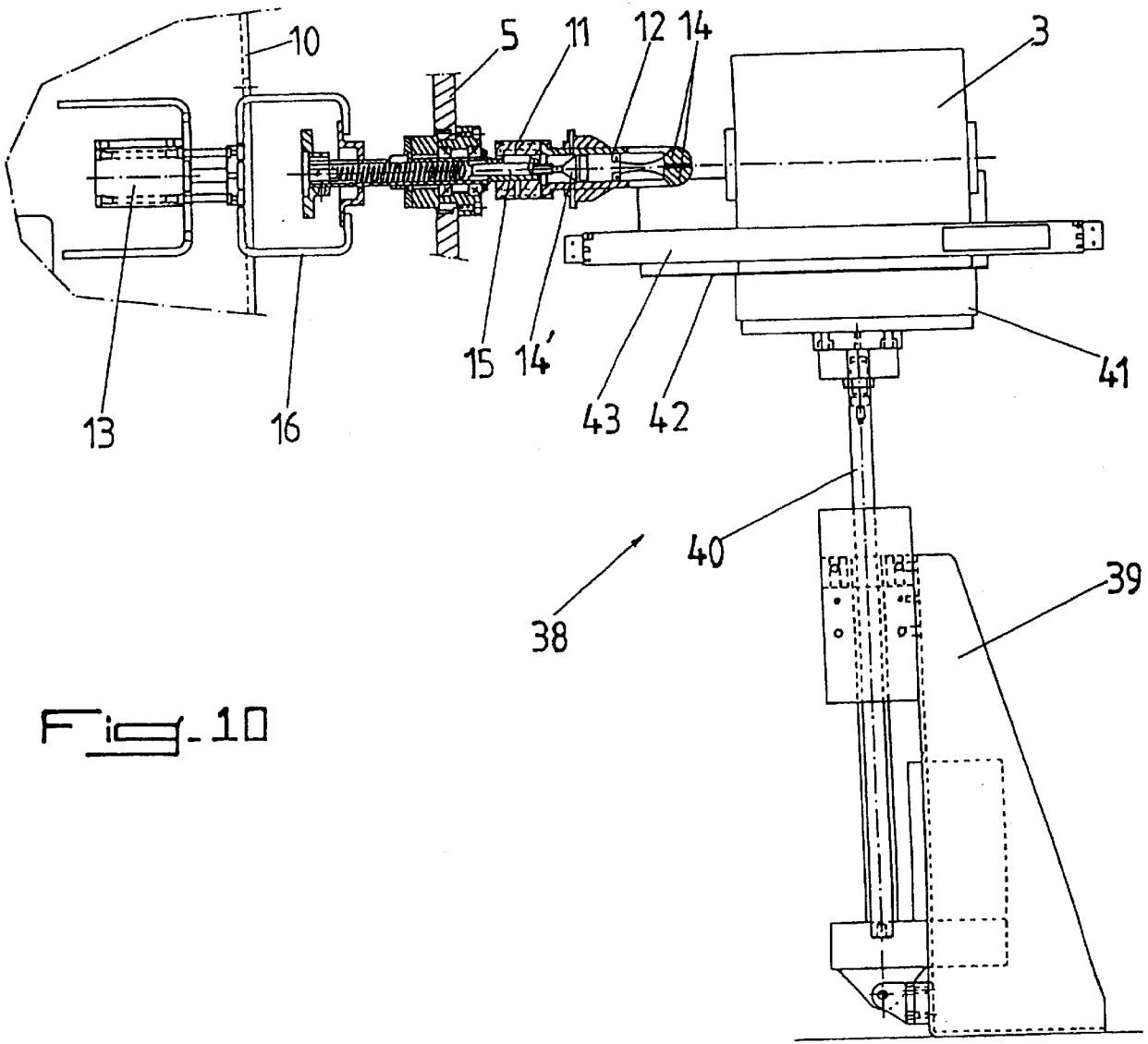
FIG. 10 is a fragmentary side elevational view, on a larger scale and particularly in cross-section of a weighing station.

As shown more particularly in FIG. 2 of the accompanying drawings, the turning plate 5 is mounted on a vertical support 10 enclosing its rotatable drive device and is provided with spindles 11 with an expansible mandrel 12 (FIG. 10), these spindles 11 being driven in rotation, in the lower position of the spools 3 corresponding to the adjustment of the length of the tag end of the thread and for tucking, by coaction with a drive motor reducer (not shown) and their expansible mandrel 12 being actuated to open and close, for the mounting and unmounting of the spools 3, by means of a pincher movement device moved by jack 13, in the upper position of the spools 3. Each expansible mandrel 12 is preferably constituted, as shown in FIG. 10, by a gripper device 14 movable in a casing of said mandrel by means of a slide 14' which is connected to a movement means 15 loaded by a spring, this movement means 15 being maneuverable by means of a stirrup 16 secured to the jack 13.

Figure 3:
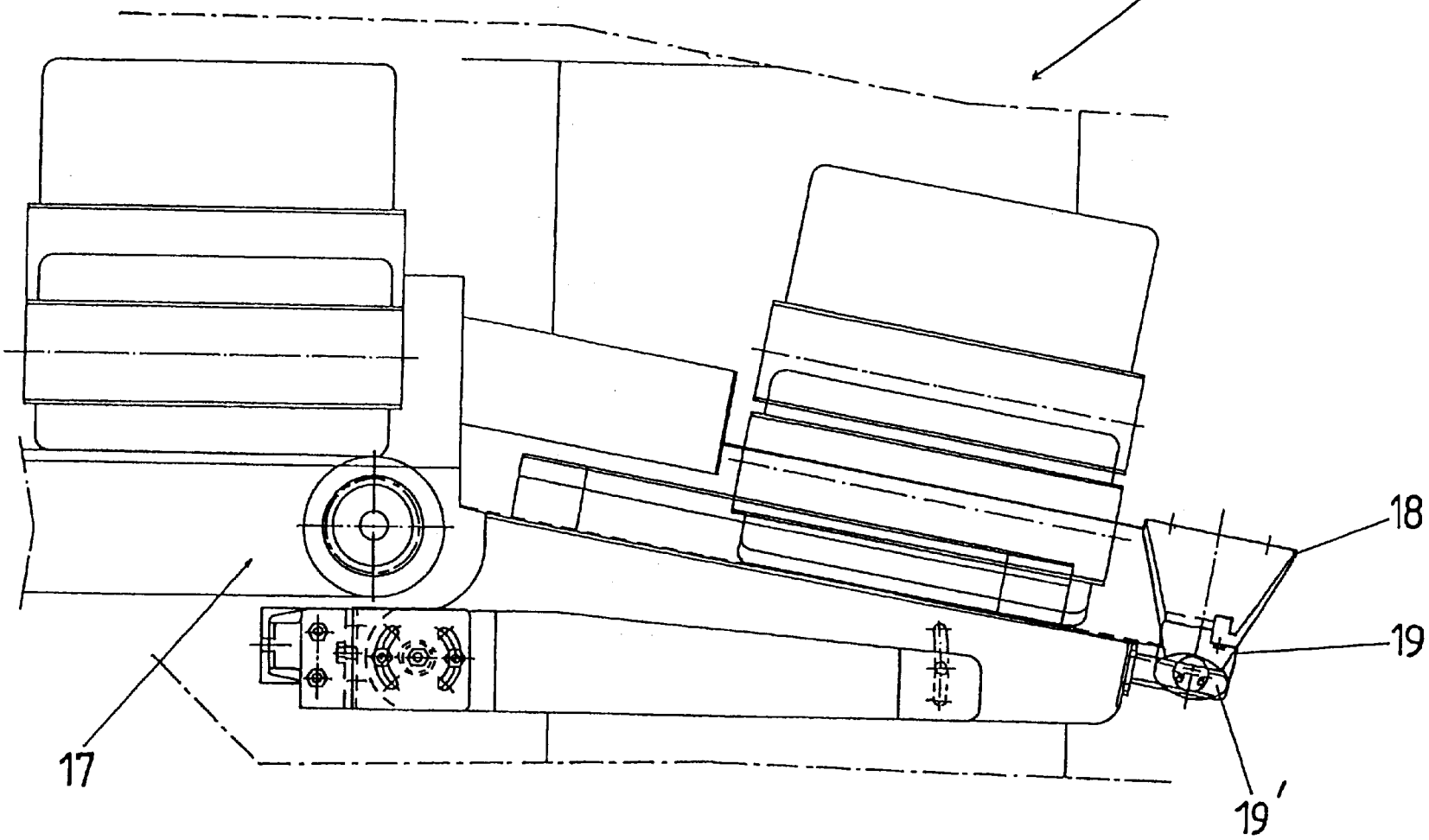
FIG. 3 is a partial side elevational view of the positioning station for spools and for cutting the trail end of the thread.
Figure 4:
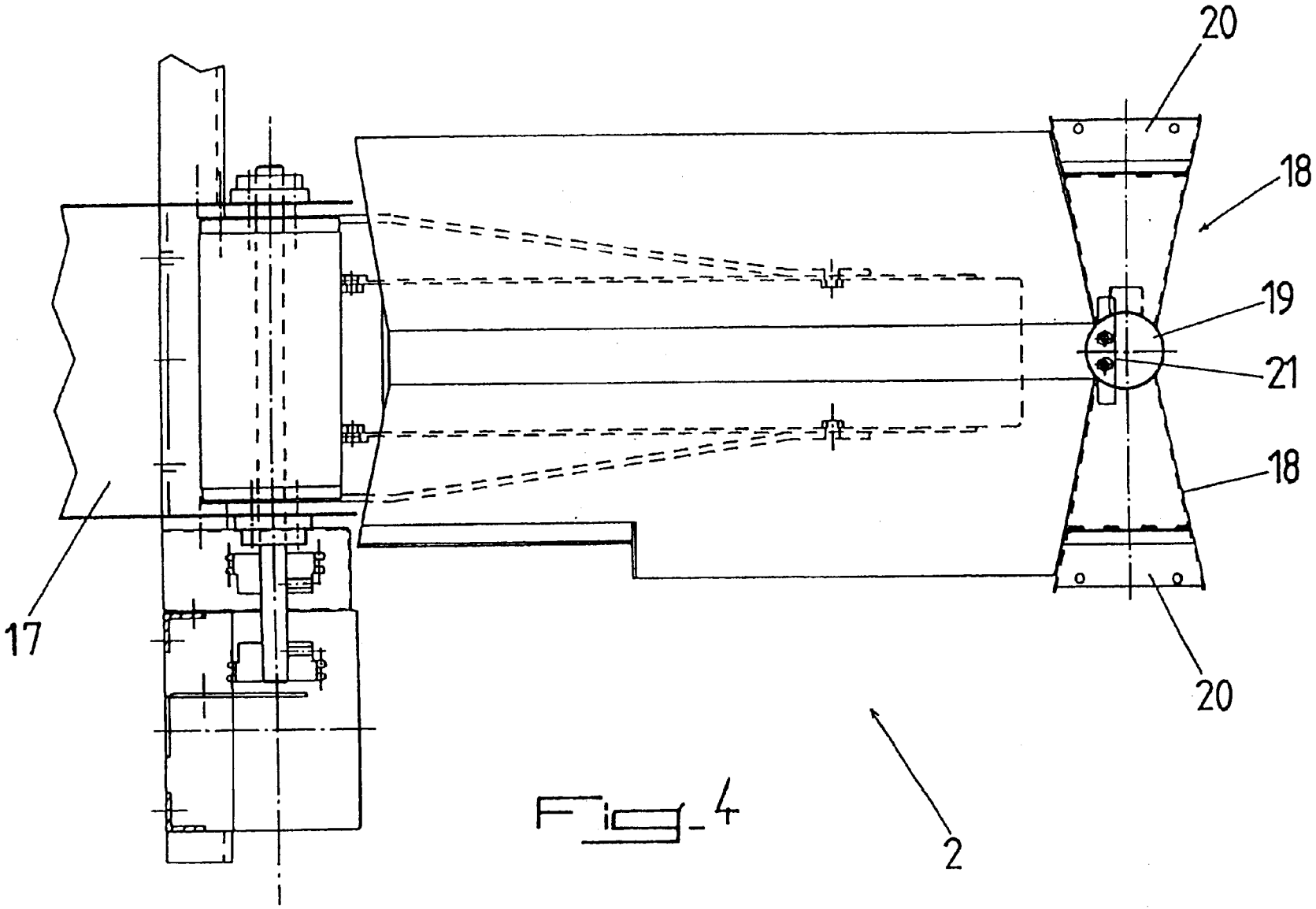
FIG. 4 is a front elevational view of the station according to FIG. 3.
Figure 5:
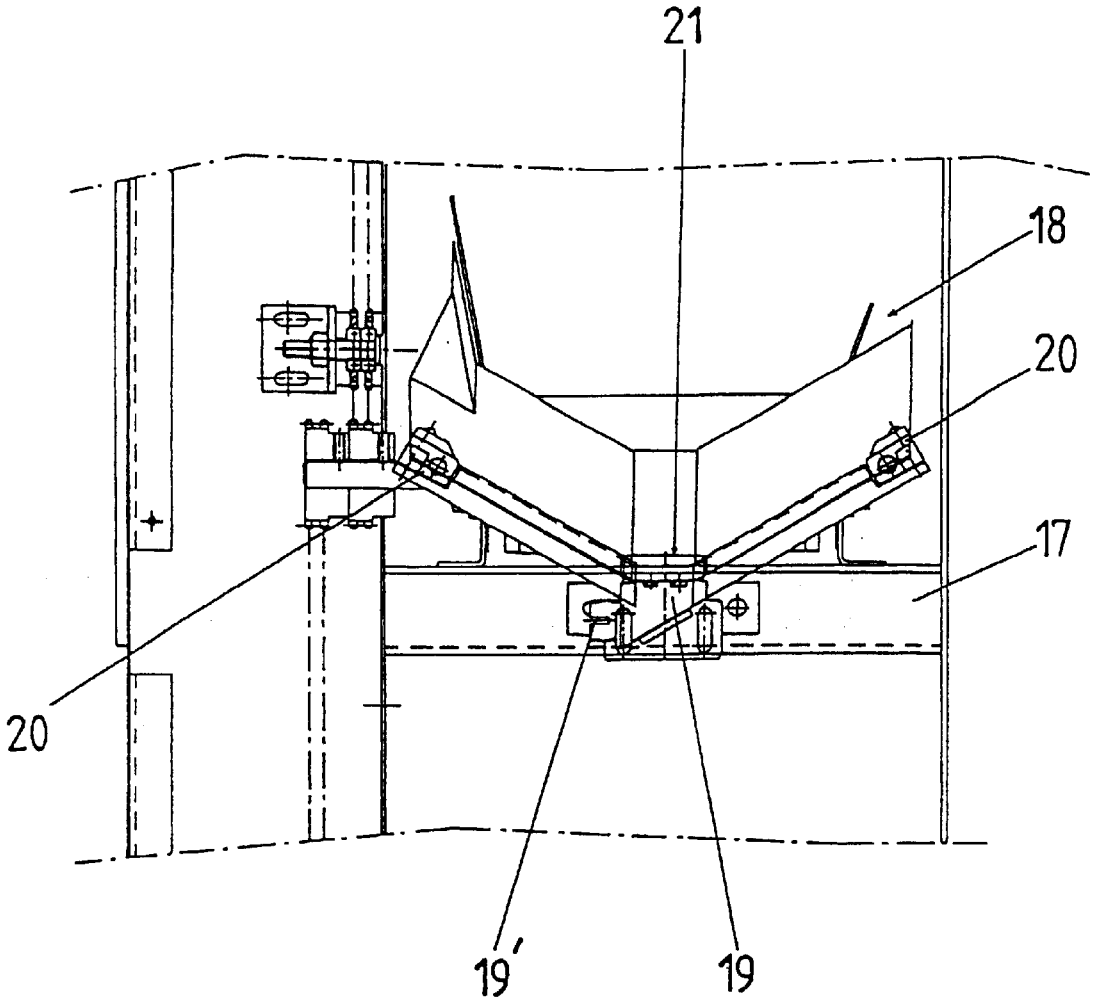
FIG. 5 is a plan view corresponding to FIGS. 3 and 4.

The station 2 for positioning the spools 3 at the outlet of the winder 1 or other machine producing spools and cutting the tag end of the thread, which is more particularly shown in FIGS. 3 to 5 of the accompanying drawings, is preferably in the form of a longitudinal channel movable vertically in front of several conveyor belts 17 at the outlet of the machine producing the spools 3 or of one or several fixed channels secured to the infrastructure of such a single belt 17 or of a corresponding number of belts 17, this belt or belts having a transverse cross-section which is troughed and being inclined downwardly from the end of said belt or belts 17 and from the upper surface of these latter and being provided at the opposite end from the belt 17 with a device 18 for gripping the tag end of the thread, cutting and eliminating it.

The provision of the channel constituting the station 2 in the form of a trough permits carrying out an automatic positioning of the spool arriving on the conveyor belt 17 along the longitudinal axis of this latter and a holding of this positioning to obtain good presentation of the spool 3 before the mandrel of the robot 4 or the like for the movement of the spool toward the turning plate 5 and its mounting on the expansible mandrel 12 of the corresponding spindle 11.

The device 18 for grasping the tag end of the thread, cutting and eliminating the latter, is preferably present in the form of two sections of trough extending transversely to the lateral surfaces of the trough constituting the station 2 and opening on a central portion 19, these trough sections being each provided with a blowing nozzle 20 directing its stream toward the center portion 19 which has an outlet 19' in the form of a venturi or any other suction device and which is provided with an electrical heating filament 21 or any other thread cutting device. Thus, before or after gripping a spool 3 by means of a robot 4, its thread end could be caught up by the air jets from the blowing nozzles 20 and directed toward the central portion 19 and toward the outlet 19' of this latter. During propulsion of the thread end by the air jets, said thread will pass in front of the electrical heating filament 21 or any other thread cutting device and will thus be cut, the cut end being then eliminated through the outlet 19' of the central portion 19 toward a receiving receptacle or the like, not shown.

The device 6 for grasping, positioning, holding and cutting to length the thread end, shown in FIGS. 2 and 6 to 8 of the accompanying drawings, is preferably mounted on the infrastructure of the vertical support 10 of the turning plate 5, by means of a vertical movable carriage 22 and is constituted by a means 23 for grasping the end of the tag end of the thread and for cutting this latter to length, by means 24 for positioning and indexing said tag end of the thread and coacting with a means 7 for needle tucking, or the like, and by a heated cutting filament 25 or any other thread cutting device.

The means 23 for grasping the end of the tag end of the thread and for cutting to length this latter, is fixed on the vertical movable carriage 22 and consists essentially of a suction nozzle with a longitudinal slot connected to a suction means (not shown). The heating cutting filament 25 or any other device for cutting the thread can be disposed in the suction nozzle constituting the means 23 for seizing the end of the tag end of the thread and for cutting it to length or can be disposed outside this latter, adjacent the means 24 for positioning and indexing the tag end of the thread.

The means 24 for positioning and indexing the tag end of the thread consists of two fingers horizontally above the region of action of the suction nozzle constituting the nozzle 23 and are mounted, the first non-movably, but with the possibility of pivoting about its vertical axis, and the second on a carriage 26 movable in the direction of the second finger, by means of a jack 26' or the like. The first finger is provided with a roller 27 adapted to coact with the corresponding cam 28 provided on the carriage 26 for moving the second finger and is loaded by a spring 29 to return it to position.

Figure 6:
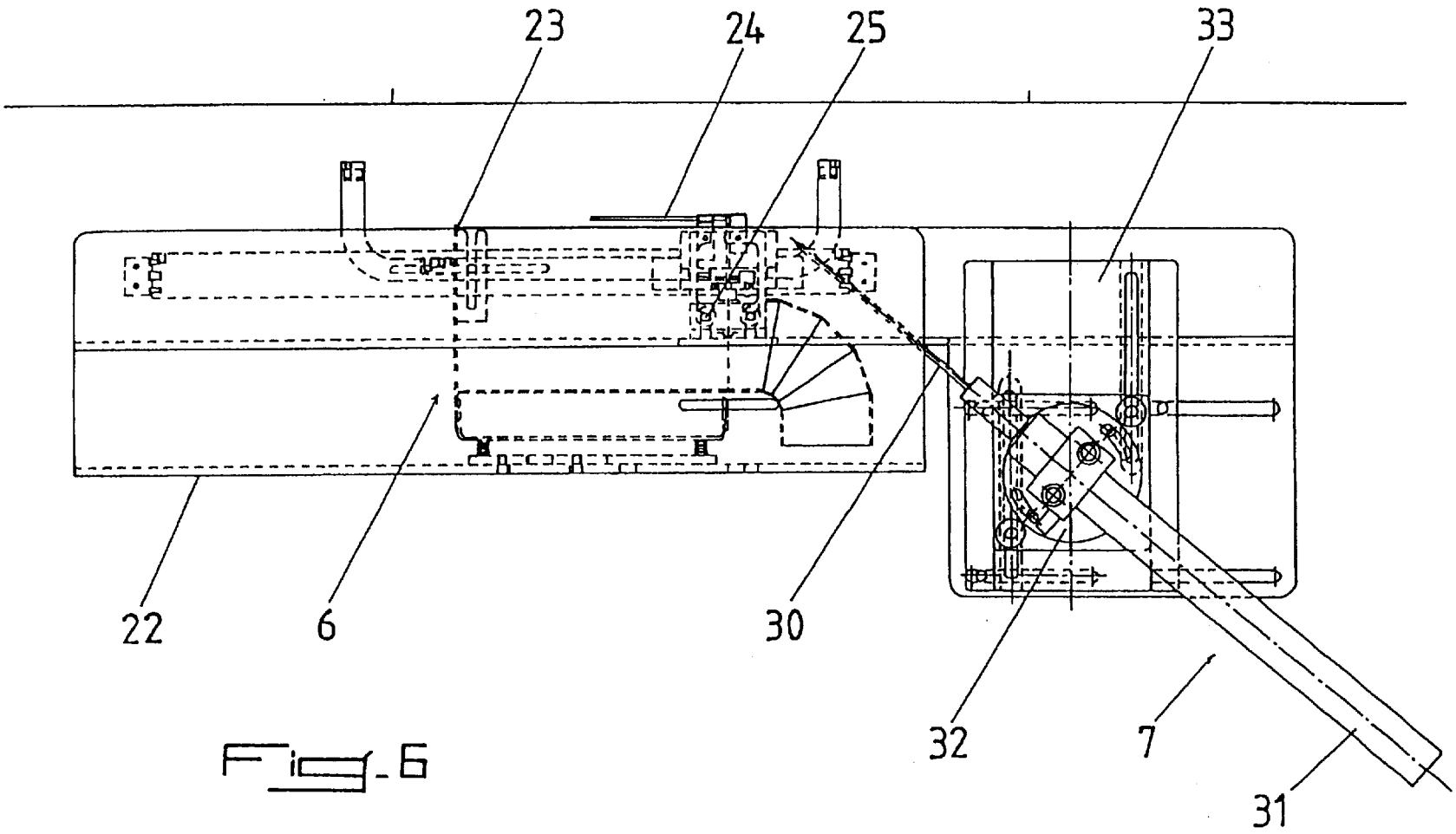
FIG. 6 is a view analogous to that of FIG. 4 showing the gripping, positioning, holding and cutting to lengths a device for the tag end of the thread and the means for needle tucking.
Figure 7:
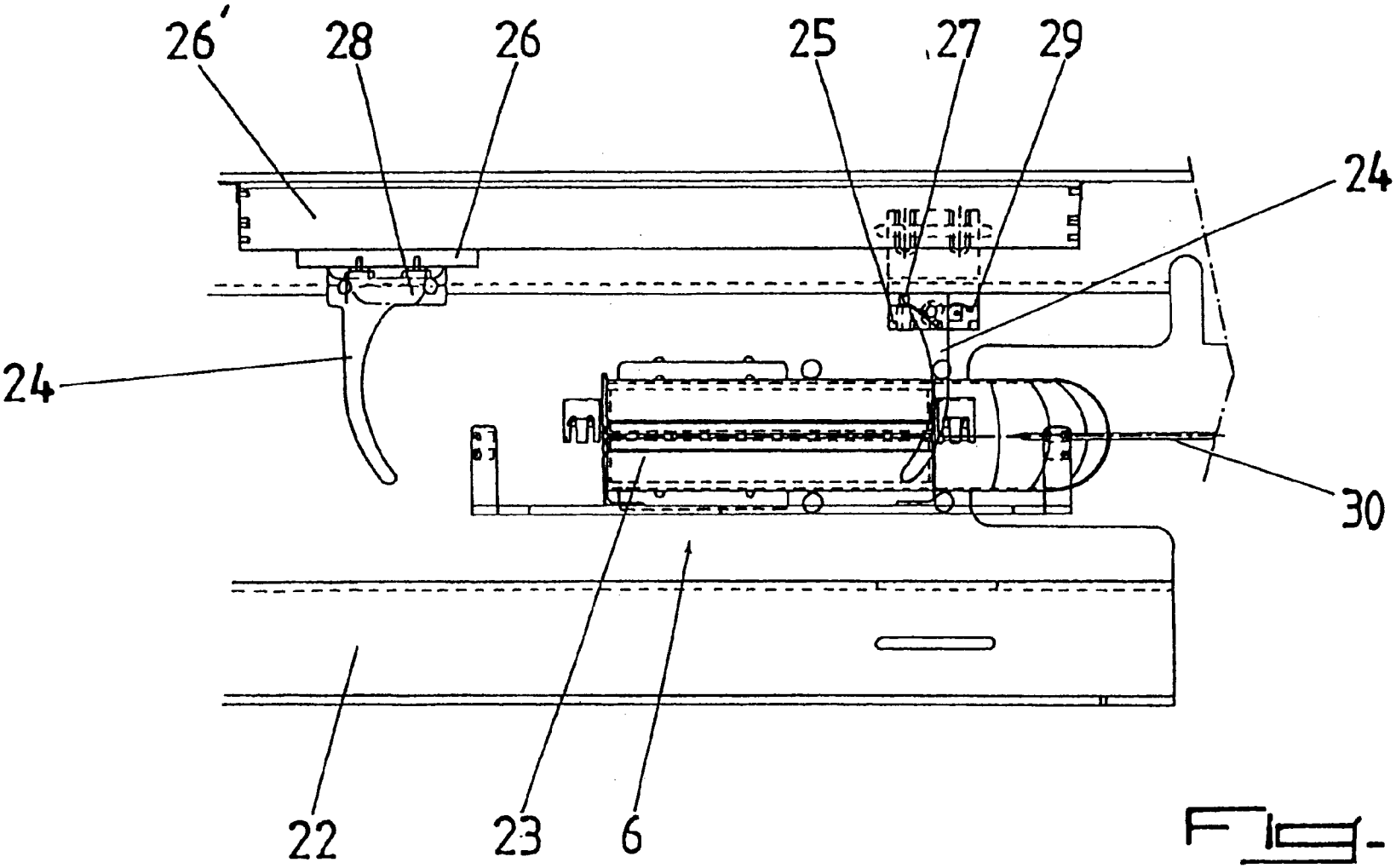
FIGS. 7 and 8 are plan views of the device according to FIG. 6, respectively in the rest position and in the thread indexing position.
Figure 8:
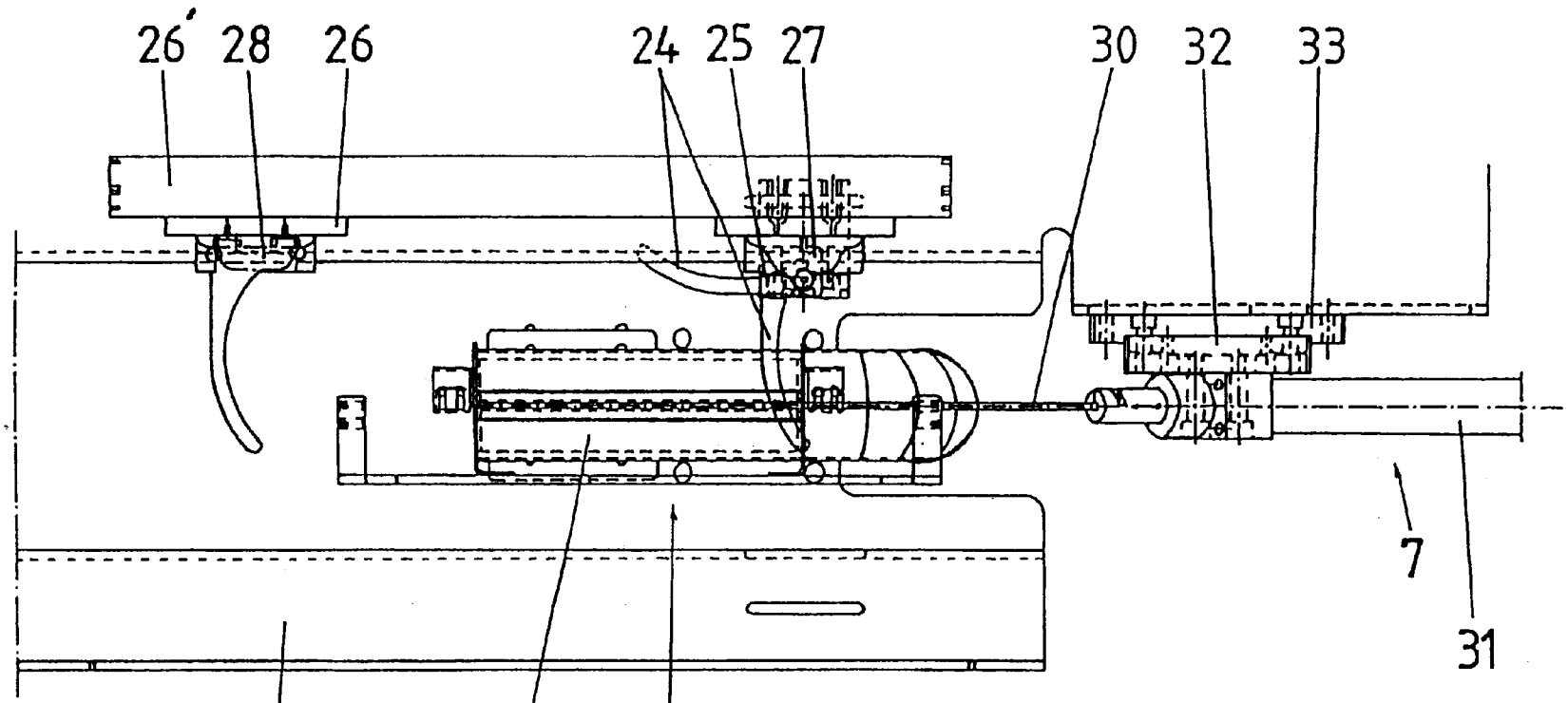
Figure 9:
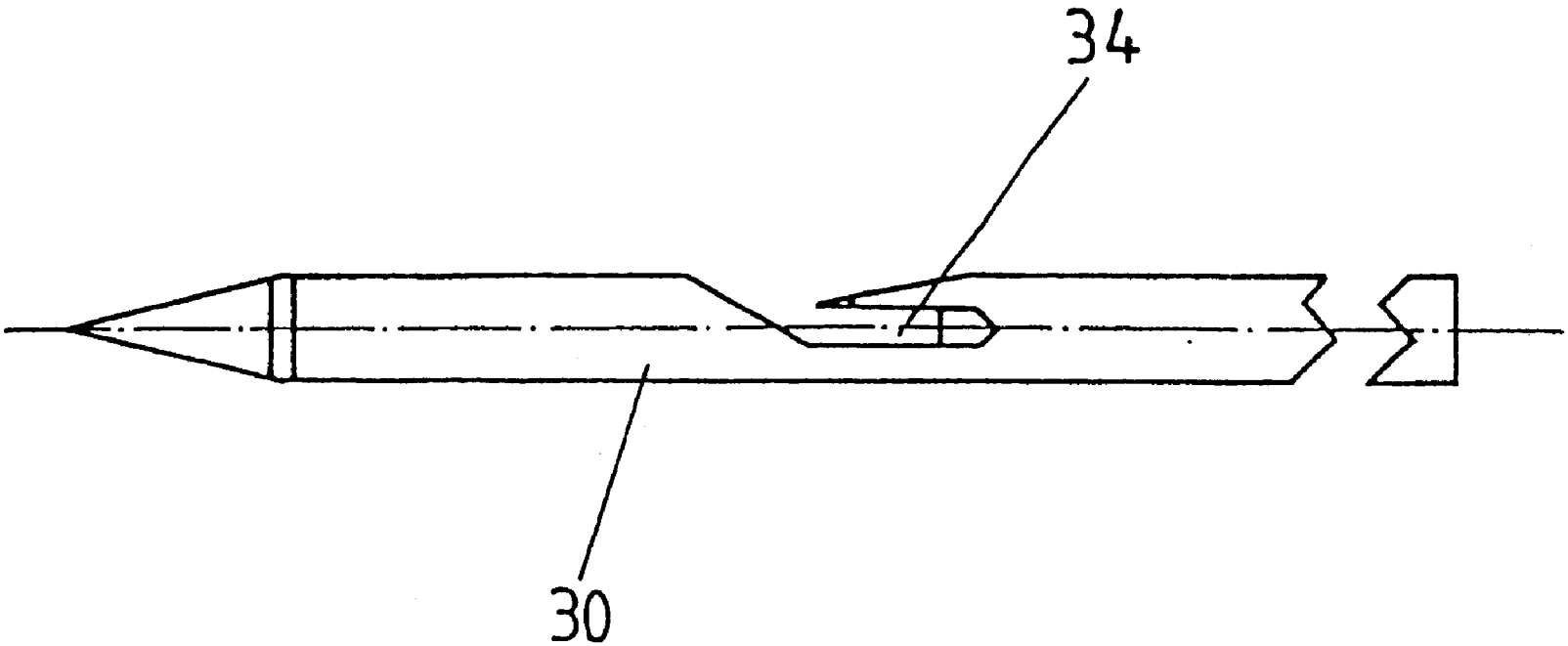
FIG. 9 is a fragmentary view on a larger scale of the tucking needle.

The means 7 for needle tucking consists essentially of a needle 30 mounted on the end of the piston rod of the jack 31 and extending obliquely relative to the longitudinal axis, on the one hand, of the spool 3 on which must be performed the tucking and, on the other hand, of the device 6 for grasping, positioning and cutting the tag end of the thread (FIGS. 6, 8 and 9). The inclination of the needle relative to the longitudinal axis of the spool is regulated by mounting the jack 31 on a plate 32 orientable in rotation, this plate being itself mounted on a carriage 33 vertically and horizontally adjustable relative to the carriage 22 for vertical movement of the device 6.

The needle 30 is provided with a reversed eye 34, shown more particularly in FIG. 9 of the accompanying drawings, this eye 34 having an introduction slot with a double sloped opening, the edge of this slot being offset inwardly of the body of the needle. The provision of such a reversed eye permits carrying out, with the same movement, the grasping of the thread and the insertion of this latter into the body of the spool, without the need for any rotative movement of the needle 30. Moreover, during retraction of the needle, damage to the spooled threads is also avoided.

Upon the arrival of a spool above the device 6, by rotation of the turning plate 5, the spool 3 is rotated by means of a motor reducer mounted in the vertical support 10 of the turning plate, said motor reducer being clutched on the corresponding portion of the spindle 11 by a control delivered by the computer control means. The rotation of the body 3 in the direction of unwinding the thread permits delivering a certain length of tag end of the thread, whose end is sucked by the nozzle forming the device 6. At the end of unrolling of a predetermined number of windings from the spool 3, the second movable finger constituting one of the means 24 for positioning and indexing the tag end of the thread is actuated to move in the direction of the first immovable finger and drives the vertically extending thread in a random manner into the path of said second finger. Upon the arrival of this second finger adjacent the first finger, its cam 28 enters into contact with the roller 27 of the first finger and drives the latter with a swinging movement by which the thread is displaced with horizontal movement outside the vertical suction plane of the nozzle forming the grasping means 23.

The computer control means, which controls the unwinding of the thread and controls the movements 23 and 24, thus delivers a movement command to the needle 30 by means of the jack 31. As a result, the brushes with the upper portion of its point the outside of the horizontally stretched thread, such that when the latter arrives at the eye 34, it enters this latter. It follows that, during subsequent movement of the needle and its penetration into the winding of the thread on the spool 3, the filament end is introduced or "tucked" into said spool and remains in this latter upon subsequent retraction of the needle 30. The remaining portion of the filament tag end sucked into the nozzle forming the means 23 is then cut under tension, by a pulse of the heated cutting filament 25 and the cut end is evacuated by the suction means toward a receptacle for collecting scrap.

The labelling station 8, shown schematically in FIG. 1 of the accompanying drawings and partially in FIG. 2 of the accompanying drawings, consists essentially of a spool 35 for unwinding strips of labels, an arm 36 for applying said labels to one end of the spools 3 or to the interior of the cores of these latter, and at a spool 37 for winding up the support strips for the labels after gluing these latter, a printer, not shown, being adapted to be provided between the spool 35 and the arm 36 to print said labels. The provision of a printer permits particularly a very rapid and individualized adaption of the labels to each spool coming in front of the station 8, as a function of data emitted from the computer control means, these data being if desired varied from one spool to another as a function of the different characteristics of the spools from the multiple station, for example a winder with several outlets for different spools.

According to another characteristic of the invention, the machine can be completed moreover by a weighing station 38 (not shown in FIG. 1 of the accompanying drawings) extending before the turning plate 5 provided with spools 3, at the level of the loading position of said turning plate 5 and which is essentially constituted by a vertical support 39 comprising a vertical moving means 40, on the upper end of which is fixed a weighing device 41 provided with a channel 42 for positioning a spool 3 and by a linear means 43 for loading the weighed spool on the expansible mandrel 12 of a spindle 11. The vertical displacement means 40 on the vertical support 39 is preferably constituted by a mechanical jack which is electrically driven or the like and the linear means 43 for loading the spool comprises preferably a pneumatic or hydraulic jack acting on a sliding cradle mounted in the channel 42 of the weighing device 41.

Thus, a spool brought from a winder or other machine producing spools and deposited by the robot 4 or the like into the channel 42 of the weighing device 41, then, after its weighing, said spool is moved, together with the device 41, by means of the vertical movement means 40, into a position of alignment of the axis of the spool 3 with the axis of the spindle 11, then said spool 3 is pushed onto the spindle 11 and the mandrel 12 of this latter by the linear means 43.

The expansible mandrel 12 of the spindle 11 is then freed and after disengagement of the device 41 downwardly, the turning plate 5 carries out one rotation bringing the spool above the device 6 and the tucking station 7.

As to the tucking operation, the spool is moved by rotation of the turning plate 5 toward a labelling position, then into a position in which the robot 4 or the like deposits said spool of said turning plate 5 to bring it toward a storage pallet. Then, the robot takes a new spool in the station 2 to begin a new handling cycle.

All of the movements of the different stations and devices of the machine according to the invention are preferably controlled by means of the computer control means according to processes known per se and which are not described in detail.

According to a modified embodiment of the invention, not shown in the accompanying drawings, the securement of the tag end of the thread on the spools can also be carried out, by replacement of the tucking by means of a needle, by securement of its end by pneumatic tangling on the spool.

Thanks to the invention, it is possible to carry out a complete handling of the spools at the outlet of the winder or of any other machines producing spools, which is to say to carry out if desired weighing of the spools, tucking these latter, their labelling and their palletization in an entirely automatic manner.

Of course, the invention is not limited to the described embodiment shown in the accompanying drawings. Modifications remain possible, particularly as to the construction of the various elements or by substitution of technical equivalents, without thereby departing from the scope of protection of the invention.

What is claimed is:

1. Machine for tucking, labelling and palletizing spools at the outlet of winders or any other machines producing spools of threads, comprising:

a station (2) for positioning spools (3) at the outlet of a winder (1) or other machine producing spools and for cutting a tag end of the thread;

a robot (4) for grasping said spools (3), for feeding said spools to a turning plate (5) and for removing said spools from said turning plate (5) and for palletizing said spools;

a device (6) for grasping, positioning, holding and cutting to length the tag end of the thread;

a means (7) for needle tucking; and a labelling station (8), an assembly of said stations and said device being computer controlled.

2. Machine according to claim 1, characterized in that the robot (4) for grasping the spools (3) at the outlet of the winder (1) or other machine producing spools comprises an articulated arm mounted on a crossbeam (9) extending from the outlet of the winder (1) and the station (2) for positioning the spools (3) and above the turning plate (5) and above the device (6) for grasping, positioning, holding and cutting to length the tag end of the thread, as well as above the means (7) for needle tucking and the labelling station (8).

3. Machine according to claim 1, characterized in that the turning plate (5) is mounted on a vertical support (10)

enclosing a rotatable drive device and is provided with spindles (11) with an expansible mandrel (12), these spindles (11) being driven in rotation in a lower position of the spools (3) corresponding to the length regulation of the tag end of this thread and to the tucking, each expansible mandrel (12) being actuatable to open and close, by the mounting and unmounting of the spools, by means of a movement device moved by a jack (13), in an upper position of the spools (3).

4. Machine according to claim 3, characterized in that each expansible mandrel (12) comprises a device with gripping pinchers (14) movable in a casing of said mandrel by means of a slide (14') which is connected to a movement means (15) loaded by a spring, th is movement means (15) being manipulable by means of a stirrup (16) secured to the jack (13).

5. Machine according to claim 1, characterized in that the positioning station (2) for the spools (3) at the outlet of the winder (1) or other machine producing spools and cutting the tag end of the thread is present in the form of a longitudinal channel displaceable vertically before several conveyor belts (17) at the machine outlet producing spools (3) or one or several fixed channels secured to the infrastructure of such a single belt (17) or of a corresponding number of belts (17), this channel or these channels having a transverse cross-section which is troughed and inclined downwardly from an end of said belt (17) or belts and from the upper surface of this or these latter and being provided at an opposite end to the belts (17) with a device (18) for grasping the tag end of the thread, cutting and eliminating the latter.

6. Machine according to claim 5, characterized in that the device (18) for grasping the tag end of the thread, cutting and eliminating the latter is present in the form of two sections of trough extending transversely to the lateral surfaces of the trough comprising the positioning station (2) and opening on a central portion (19), these trough sections being each provided with a blowing nozzle (20) directing its jet toward the central portion (19) which has an outlet (19') in the form of a venturi or any other suction device and which is provided with an electric heating filament (21) or any other thread cutting device.

7. Machine according to claim 1, characterized in that the device (6) for grasping, positioning and holding and cutting the length of the tag end of the thread is mounted on the infrastructure of a vertical support (10) of the turning plate (5) by means of a vertically movable carriage (22) and is comprised by a means (23) for grasping the end of the tag end of the thread and for cutting to length this latter, by means (24) for positioning and indexing said tag end of the thread and coacts with a means (7) for needle tucking, and by a heated cutting filament (25) or any other thread cutting device.

8. Machine according to claim 7, characterized in that the means (23) for grasping the end of the tag end of the thread and for cutting it to length is fixed on the vertical movable carriage (22) and comprises a suction nozzle with a longitudinal slot connected to a suction means.

9. Machine according to claim 7, characterized in that the heated cutting filament (25) or any other device for cutting threads is disposed in a suction nozzle comprising the means (23) for grasping the end of the tag end of the thread and for cutting it to length or is disposed outside this means, adjacent the means (24) for positioning and indexing the tag end of the thread.

10. Machine according to claim 7, characterized in that the means (24) for positioning and indexing the tag end of the thread consists of two fingers extending horizontally above the action zone of a suction nozzle comprising the nozzle (23) and mounted, a first of the two fingers in an immovable manner, but with the possibility of pivoting about its vertical axis and, a second of the two fingers, on a carriage (26) displaceable in the direction of the second of the two fingers, by means of a jack (26').

11. Machine according to claim 10, characterized in that the first of the two fingers is provided with a roller (27) designed to coact with a corresponding cam (28) provided on the carriage (26) for displacement of the second of the two fingers and is loaded by a spring (29) for returning to position.

12. Machine according to claim 1, characterized in that the means (7) for needle tucking comprises a needle (30) mounted on a rod of a piston of a jack (31) and extending obliquely relative to a longitudinal axis, on the one hand, of the spool (3) on which is to be carried out the tucking and, on the other hand, of the device (6) for grasping, positioning and cutting the tag end of the thread.

13. Machine according to claim 12, characterized in that an inclination of the needle relative to the longitudinal axis of the spool is adjustable by mounting of the jack (31) on a plate (32) orientable in rotation, this plate being itself mounted on a carriage (33) adjustable vertically and horizontally relative to another carriage (22) for vertical displacement of the device (6).

14. Machine according to claim 12, characterized in that the needle (30) is provided with a reversed eye (34) having an introduction slot with a double sloped opening, the edge of this slot being offset inwardly of the needle body.

15. Machine according to claim 1, characterized in that the labelling station (8) comprises a spool (35) for unwinding strips of the labels, an arm (36) for applying said labels to one end of the spools (3) or to the interior of the cores of the spools (3) and another spool (37) for winding up the strips of label supports, a printer being adapted to be provided between the spool (35) for unwinding strips and the arm (36) to carrying out printing of said labels.

16. Machine according to claim 1, characterized in that the machine is completed moreover by a weighing station (38) extending in front of the turning plate (5) provided with spools (3), at the level of the loading position of said turning plate (5) and which is comprised by a vertical support (39) comprising a vertical movement means (40), on the upper end of which is fixed a weighing device (41) provided with a channel (42) for positioning said spool (3) and by a linear means (43) for loading the weighed spool on an expansible mandrel (12) of a spindle (11).

17. Machine according to claim 16, characterized in that the vertical movement means (40) provided on the vertical support (39) comprises a mechanical jack with electrical drive and the linear means (43) for loading the spool comprises a pneumatic or hydraulic jack acting on a sliding cradle mounted in the channel (42) of the weighing device (41).

18. Process for handling spools at the outlet of winding or other machines used by the machine according to claim 1, comprising the computer-controlled steps of positioning said spools (3) at the outlet of the machine (1) producing said spools, cutting the tag end, grasping said spools by the robot (4) and bringing said spools to the turning plate (5), grasping, positioning, holding and cutting to length the tag end of the thread, tucking or fixing said thread by the tucking means (7) with the needle, labelling each of said spools (3), then unmounting the spools individually and depositing said spools on a reception pallet.

19. Machine for tucking, labelling and palletizing spools at the outlet of winders or any other machines producing spools of threads, comprising:

a station (2) for positioning spools (3) at the outlet of a winder (1) or other machine producing spools and for cutting a tag end of the thread;

a robot (4) for grasping said spools (3), for feeding said spools to a turning plate (5) and for removing said spools from said turning plate (5) and for palletizing said spools;

a device (6) for grasping, positioning, holding and cutting to length the tag end of the thread;

a pneumatic means securing the tag end of the thread to a corresponding spool; and a labelling station (8), an assembly of said stations and said device being computer controlled.

* * * * *